United States Patent [19]

Gilano et al.

[11] Patent Number: 5,018,979

[45] Date of Patent: May 28, 1991

[54] MAGNETIC VISUAL DISPLAY

[75] Inventors: Michael Gilano, Irvine, Calif.; Gordon B. Langford, Sandy, Utah; Michael A. Gilano, Irvine, Calif.

[73] Assignee: The Ohio Art Company, Bryan, Ohio

[21] Appl. No.: 437,744

[22] Filed: Nov. 16, 1989

[51] Int. Cl.[5] ..... B43L 1/00

[52] U.S. Cl. ..... 434/409; 434/309

[58] Field of Search ..... 434/409, 309; 346/74.3, 346/74.7

[56] References Cited

U.S. PATENT DOCUMENTS

| | | | |
|---|---|---|---|
| Re. 25,363 | 4/1963 | Tate . | |
| Re. 25,822 | 7/1963 | Tate . | |
| T921,007 | 4/1974 | Foley . | |
| 2,589,601 | 3/1952 | Burnett | 434/309 |
| 3,011,854 | 12/1961 | Allen . | |
| 3,036,388 | 5/1962 | Tate . | |
| 3,103,751 | 9/1963 | McDonald . | |
| 3,322,482 | 5/1967 | Harmon . | |
| 3,509,644 | 5/1970 | Santell . | |
| 3,585,735 | 6/1971 | Miller . | |
| 3,648,269 | 3/1972 | Rosenweig et al. . | |
| 3,683,382 | 8/1972 | Ballinger | 346/74.3 |
| 3,938,263 | 2/1976 | Tate . | |
| 3,982,334 | 9/1976 | Tate | 434/309 |
| 4,143,472 | 3/1979 | Murata et al. | 434/309 |
| 4,232,084 | 11/1980 | Tate . | |
| 4,288,936 | 9/1981 | Okutsu . | |
| 4,451,985 | 6/1984 | Pullman . | |
| 4,457,723 | 7/1984 | Tate . | |
| 4,536,428 | 8/1985 | Murata et al. . | |
| 4,643,684 | 2/1987 | Murata et al. . | |
| 4,804,327 | 2/1989 | Miller . | |

FOREIGN PATENT DOCUMENTS

| | | |
|---|---|---|
| 810324 | 4/1969 | Canada . |
| 2034640A | 6/1980 | United Kingdom . |

OTHER PUBLICATIONS

Paradise Creations, Inc. (1987): Erase-A-Slate, front box view.

Blue-Box Toys, Magnetic Magic Trace (1974); front box view, rear box view.

Rose Art Brand, Magnetic Golden Slate (1989): front box view, rear box view.

*Primary Examiner*—Richard J. Apley

*Assistant Examiner*—Glenn E. Richman

*Attorney, Agent, or Firm*—Knobbe, Martens Olson & Bear

[57] ABSTRACT

An apparatus and method for providing a magnetic display in which a magnetic field produces visual patterns upon exposure to the apparatus. The apparatus comprises an enclosure which contains magnetically active flakes held within a dispersion medium which holds the magnetically active flakes in suspension, yet allows alignment of the flakes along the flux lines of the magnetic field when the flakes are exposed to the locus of the magnetic field.

25 Claims, 2 Drawing Sheets

MAGNETIC VISUAL DISPLAY

BACKGROUND OF THE INVENTION

The present invention relates to a magnetic visual display that uses magnetic force to orient magnetically active flakes contained within a dispersion medium to allow light to pass therethrough.

The existing techniques of forming a visual display through magnetic means generally comprise applying a magnetic field to fine magnetic particles dispersed within a viscous liquid. The particles migrate to the magnetic field and accumulate along the locus of the field, thereby creating an image comprising an accumulation of the particles along the locus of the magnetic field.

The attractability of these particles may be defined as an additive process, that is, prior to drawing, the entire field of visible background is generally void of any magnetic particles. When a magnetic field is displayed to the liquid, the magnetic particles are drawn up from the bottom of the liquid to the top of the liquid, thus producing a visible image at the top surface.

However, after attraction, the particles tend to precipitate away from the surface of the liquid, making it difficult to retain the image over an extended period of time. Additionally, since the magnetic particles within the influence of the magnetic field are attracted to the field, magnetic particles follow the locus of the magnetic field and are carried away from the desired area of demarcation; thus forming a discontinuous line with reduced contrast and resolution.

The prior art has dealt with contrast and resolution difficulties in a number of ways. For instance, the patent to Murata, et al. (U.S. Pat. No. 4,643,684), discloses the use of a magnetic display panel having a dispersing medium having a yield value of 5 dyne/cm$^2$ or more, the medium comprising an inorganic thickener, fine magnetic particles, and a colorant. Murata discloses the use of a multi-cell structure which confines the dispersing medium within each cell, the structure assisting in limiting the migration of the medium and the magnetic particles from one cell into the next during the application of a magnetic field to the particles.

However, regardless of the precautions taken by the prior art, the action of the magnetic field on the magnetic particles dispersed within the liquid of the prior magnetic marking devices produces a number of inherent difficulties.

For example, during movement of the magnetic field across the magnetic particle containing liquid, the magnetic particles move through the liquid, from the bottom of the liquid to the top of the liquid, to the magnetic field. This localized movement of particles through the liquid creates a void of particles within the liquid. This void is created when the particles are pulled through to and along the top layer of the substrate by their attraction to the magnetic field. When the magnetic field is moved, as when the device is used for drawing purposes, the attracted particles are pulled along the locus of the magnetic field, throughout the substrate, creating an incomplete distribution of particles.

Additionally, a magnetic field is required to erase the image produced by these prior art devices. The erasing magnet repositions the magnetic particles after magnetic field attraction. Thus, when the cleaning or erasure of a display is desired, a magnetic field is applied to the bottom of the device to draw the magnetic particles from the top of the liquid to their original position at the bottom of the liquid, thus eliminating the image-producing particles from the top of the liquid. However, there exist a number of limitations of this technique of erasure. For instance, incomplete or nonuniform application of the magnetic field across the bottom of the liquid produces localized areas of particle accumulation after erasure, thus preventing the subsequent drawing of a true line during application of the magnetic field to the top of the liquid due to the incomplete distribution of particles throughout the liquid. Additionally, after repeated use and erasure by magnetic means, it becomes extremely difficult to redisperse the particles to attain uniformity throughout the liquid due to the magnetically attractive properties of the particles. Thus, there exists a need for an apparatus and method for producing a magnetic display which eliminates the drawing and erasure difficulties inherent in the additive processes used in the prior art magnetic display devices.

The present invention provides a magnetic visual display which is true, uniform, and of high resolution and contrast. The present invention also provides a method and apparatus for producing an image by orienting magnetically active flakes contained within a dispersion medium such that when a magnetic field is displayed to the flakes within the dispersion medium, the magnetically active flakes are oriented to change the light transmission characteristics of the dispersion medium. The orientation of the magnetically active flakes of the present invention occurs without gross translation of the flakes within the dispersion medium, thus providing a uniform, consistent dispersion of the flakes throughout the medium.

SUMMARY OF THE INVENTION

A magnetic marking apparatus is described herein, the apparatus comprising an enclosure having at least one transparent or translucent surface area; a dispersion medium which has a plurality of magnetically active flakes contained within it; and a magnet comprising a magnetic field. The magnetic field has a plurality of flux lines. When the magnetic field and its flux lines are displayed to the magnetically active flakes, the flakes align along the flux lines of the magnet, thus changing the light transmission characteristics of the dispersion medium to produce an image. The magnetically active flakes may comprise nickel flakes, and the translucent or transparent surface area of the enclosure may be deformable to the touch, to provide complete or discrete erasure capability.

A magnetic display panel is also disclosed, comprising an enclosure having a front and a rear panel, forming a liquid sealing space with at least one of the front or rear panels having a transparent or translucent area. The panel also contains a dispersion medium comprising a plurality of magnetically active flakes, the dispersion medium sealed in a liquid sealing space formed between the front and the rear panels. The display panel also comprises a magnet comprising a magnetic field, the magnetic field comprising a plurality of flux lines. When the magnetic field is displayed to the flakes, the flakes align along the flux lines of the magnetic field, thus changing the light transmission characteristics of the dispersion medium.

A method for orienting magnetically active flakes is also disclosed, the method comprising the steps of mixing magnetically active flakes within a dispersion medium; distributing the medium uniformly within a container, the container having at least one transparent or translucent areas; displaying an oriented magnetic field to the container, the field having a plurality of flux lines; and changing the light transmission characteristics of the medium by aligning the flakes along the flux lines.

DETAILED DESCRIPTION OF THE PREFERRED EMBODIMENT

Figure 1:
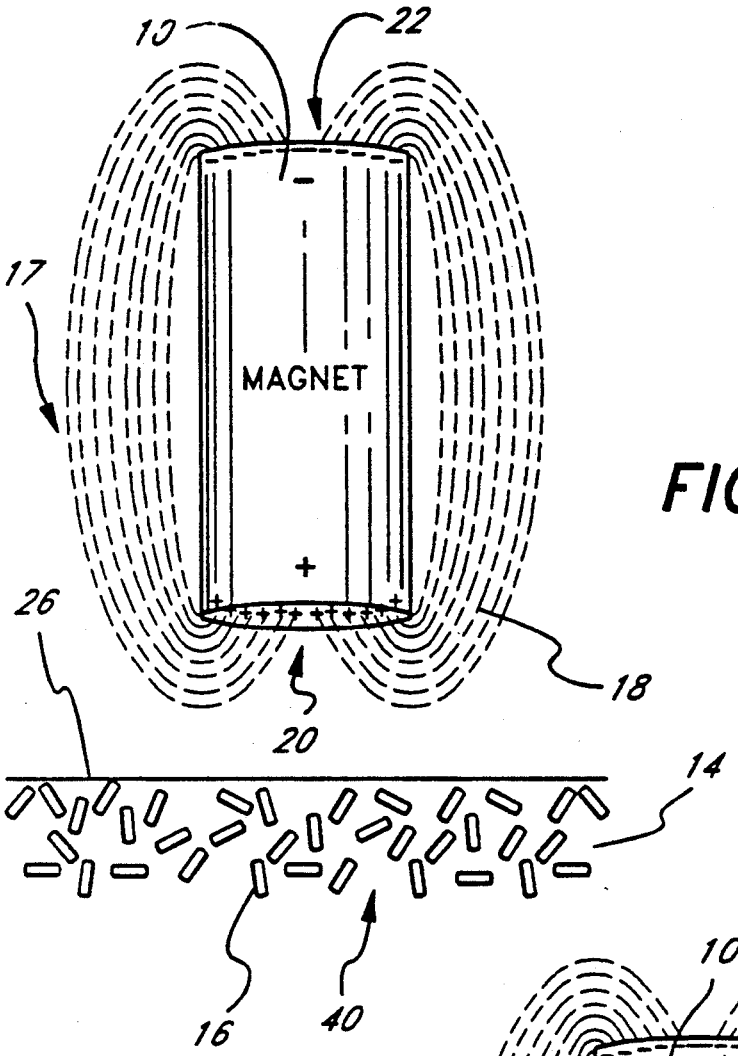
FIG. 1 is a perspective view of the magnetically active flakes of the present invention dispersed within the dispersion medium, with a magnet suspended above the medium, yet not influencing the flakes.

In the magnetic display of the present invention, an image is formed by aligning magnetically active flakes contained within a dispersion medium along the flux lines of a magnetic field. Alignment of the flakes provides a change in light transmission through the dispersion medium, thereby creating a visible image.

When a magnetic field is applied from a permanent magnet, for instance, those comprised of iron nickel alloy composition or an amorphous magnet of iron nickel boron composition, magnetically active particles tend to be attracted to the magnetic field of the magnet and accumulate at the locus of the field.

This phenomenon of induced magnetism in magnetically active particles may also be observed by dispersing the magnetically active particles within a viscous liquid. By dispersing the particles in a viscous liquid, the viscosity of the liquid slows down the magnetic alignment of the particles by the counter force of friction. Thus, these magnetically active particles are observed to flow through the liquid to a magnetic field presented to the external surface of the liquid, thus forming an accumulation of magnetically active particles along the surface of the liquid at the locus of the magnetic field.

The thickness of the layer of these magnetically active particles will be some function of the concentration of particles in the liquid and may range from a monolayer to a multi-tiered layer, depending on the number and density of magnetically active particles and the area and density of the magnetic field.

It has been observed that the overall geometry of each of these magnetically active particles exhibiting this attraction phenomenon which travel through the viscous liquid to the magnetic field have a geometry which is generally spherical. In fact, it has been observed that as these magnetically active particles become more spherical in shape, the travel of the particles through the viscous liquid to the applied magnetic field occurs with greater frequency and becomes more apparent. However, as the configuration of the magnetically active particles becomes less spherical and more flattened or flake-like, these particles tend to align along the flux lines of the magnetic field and not travel through the viscous liquid to the locus of the magnetic field, remaining relatively stationary. Thus, the ability of the particles to form an image in the present invention is dependent on the geometry of the magnetically active particles.

One measure of the geometry of a particle is the ratio of a particle's length to width to height. For convenience, this ratio is defined as the aspect ratio of the particle. Determination of the aspect ratio of a magnetic particle provides a measurement in absolute terms of the geometry of a magnetic particle. Calculation of the aspect ratio thus provides a standard for selecting metallic particles for use in the present invention which have the desired alignment characteristics along the flux lines of the applied magnetic field.

In a spherical particle, the aspect ratio is 1:1:1, or unity. Particles with an aspect ratio approximating unity generally do not align along the flux lines of the magnetic field when contained in a viscous liquid, but exhibit the attraction and movement phenomenon as described above, traveling through the liquid and accumulating at the locus of the magnetic field.

For instance, commercially available metal particles such as Inco Nickel Powder Type 123, have a particle size approximating four microns with the particles having a dendritic geometry. However, due to the small, irregular size of the particles, it is difficult to determine which is the longest axis for determination of an aspect ratio of the particles. Nonetheless, these particular particles behave like spherical particles having an aspect ratio of unity when they are exposed to a magnetic field. In like manner, spherical nickel particles, such as those commercially available from Novamet, Inc., (Novamet 4SP), an eight-micron diameter sphere with an aspect ratio of unity, will travel through a dispersion medium when attracted to a magnetic field and not align along the flux lines of the magnetic field. (Commercially available ferrous powders, such as 325 mesh and 100 mesh by Hoeganaes, also exhibit the attraction phenomenon.)

It is when the aspect ratio of the particles varies from that of unity that the particles tend to line up with their longest axis in the direction of the flux lines of an applied magnetic field, providing the alignment and change in light transmission characteristics of the present invention.

Magnetically active particles, including metallic and non-metallic particles having an aspect ratio greater than unity which exhibit the alignment phenomenon along the flux lines of an applied magnetic field, are hereinafter referred to as magnetically active flakes. Magnetically active flakes are thus defined as metallic particles exhibiting the alignment characteristics which provide the change in the light transmission characteristics of the dispersion medium of the present invention. For instance, flakes that are 15 microns in length and width and 1 micron in height have an aspect ratio of 15:15:1. With an aspect ratio of 15:15:1, these flakes exhibit the alignment phenomenon along the flux lines of a magnetic field. Also, because of the induced magnetic field properties of the flakes after exposure to the magnetic field, the flakes exhibit both attraction and repulsion characteristics which assist in producing and maintaining flake alignment and resist translational movement of the flakes. The alignment of the flakes along the magnetic flux lines coupled with their attraction and repulsion properties relative to each other when aligned provide the desired change in light transmission characteristics in the dispersion medium.

Another example of a magnetically active flake exhibiting the aspect ratio phenomenon which provides the desired alignment properties in the present invention are magnetic fine cylindrical fibers. For instance, when seven-micron diameter nickel-coated graphite fibers are cut to 50-micron lengths, these fibers have an aspect ratio of 50:7:7 and exhibit the desired alignment characteristics within the dispersion medium of the present invention during exposure to the flux lines of a magnetic field.

Preferably, complete alignment of the flakes will occur in the present invention when the flakes are exposed to the magnetic field, assuming that each of the flakes has the proper geometry or aspect ratio to align itself with the flux lines of the magnetic field. However, differences in the aspect ratios between individual flakes used in the present invention may produce an incomplete alignment of each flake in the system when a magnetic field is introduced thereto. However, the alignment effect is most pronounced as the average aspect ratio increases within a given population of magnetic flakes.

A population of magnetically active flakes with an aspect ratio having at least two of the height, length or width measurements of preferably approximately about 5:1 or greater, or, most preferably, approximately about 10:1 or greater is preferred to overcome most effects of varying flake size. Magnetically active flakes having aspect ratios in these ranges have been observed to provide the desired change in light transmission in the dispersion medium during flake alignment. However, in the event irregularly-shaped flakes (which prevent true measurement of absolute length, width or height) are used in the present invention the measurements used to calculate the aspect ratio preferably correspond to the longest linear measurement along the geometry of the flake, the other aspect ratio measurements taken perpendicular thereto.

The relative density of the flux lines of a magnetic field can be taken as a measure of the field strength of the magnet or magnetic field source. Thus, magnetic field strength or flux line density varies both according to the relative strength of the magnetic field and to the configuration of the magnet or magnetic field source. Therefore, the strength of the magnet and density of the flux lines is an important factor to consider in inducing the flake alignment phenomenon of the present invention.

The relative density of the flux lines, particularly around the outer portions of the magnetic field and the extent to which they extend outwardly along the edges of the magnetic field also determine the extent to which the magnetically active flakes line up along the lines of flux.

Referring to the Figures, FIG. 1 shows a magnet 10 suspended above a dispersion medium 14 within which are suspended a plurality of magnetically active flakes 16 in a random position 40. Separating the dispersion medium 14 from the magnet 10 is a surface 26. The surface 26 preferably comprises a transparent or translucent area which allows observation of the flake alignment phenomenon through it, as will be discussed in detail hereinafter. The magnet 10 has a positive pole 20 and a negative pole 22, the magnet having a magnetic field 17 comprising a plurality of flux lines 18 radiating around its circumference.

Figure 2:
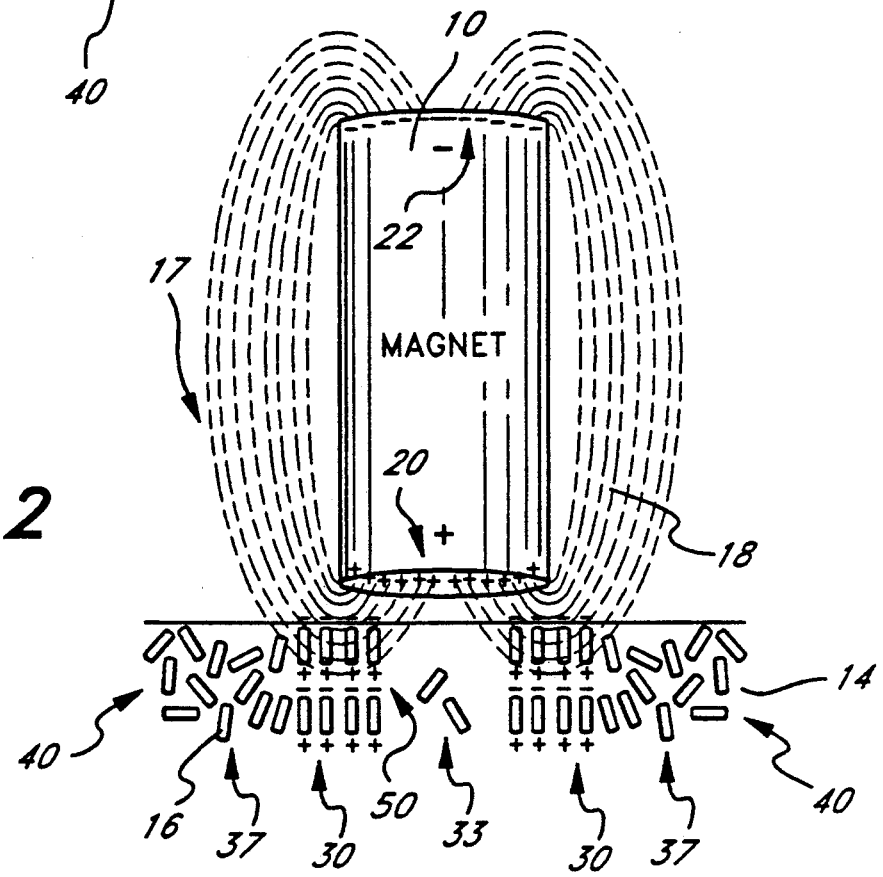
FIG. 2 is a perspective view of the present invention, the magnetic flux lines extending into the dispersion medium and influencing the flakes.

Referring to FIG. 2, the magnet 10 is shown interacting with the dispersion medium 14. As the flux lines 18 of the magnetic field 17 descend into the dispersion medium 14 past the surface 26, the magnetically active flakes 16 orient themselves along the flux lines 18. In this particular embodiment of the present invention, a variety of alignment zones are observed. With the magnet 10 having flux lines 18 extending therefrom in a manner depicted as in FIGS. 1 and 2, the magnetically active flakes 16 exhibit the alignment phenomenon in the areas where the flux lines 18 extend into the dispersion medium 14.

The alignment zone 30 shows two layers of magnetically active flakes 16 aligned along the lines of flux, with the phenomenon of induced magnetism producing magnetic charges upon the flakes, indicated as (+) and (−) 50. The induced magnetism of the magnetic flakes 16 not only assists in the alignment phenomenon by stacking the flakes 16 so that their positive (+) and negative (−) poles are attracted to each other, thus providing the columnar alignment, but the charges 50 also provide lateral repulsion characteristics so that the aligned flakes 16 also remain in formation, and are not attracted or additionally dispersed throughout the dispersion medium 14. When a cylindrical magnet 10 having flux lines 18 such as that depicted applies its flux lines 18 to the dispersion medium 14, a slight void zone 33 may occur where some of the flakes 16 directly beneath the magnetic field 17 and not directly influenced by the flux lines 18 remain in the random orientation, yet, those flakes 16 in the periphery of the void zone 33 translate to and are attracted by the flux lines 18 to the alignment zone 30.

It has also been observed that at the periphery of the alignment zone 30, the flakes 16, when exposed to the flux lines 18 of the magnet 10 as depicted herein, tend to move out of their random orientation and produce a somewhat V-shaped orientation, the open part of the V facing the magnet 10, the closed part of the V facing away from the magnet. The V-shaped alignment of the flakes 16 in the V-zone 37 also change the light transmission characteristics of the dispersion medium 14 to some extent, as the V-shaped orientation of the flakes 16 tends to relatively decrease transmission of light through the V-zone of the medium 14 and reflect light exposed to the surface of the dispersion medium 14, thus providing a "halo" effect along the edges of the alignment zone 30 which results in even greater contrast for the image produced by the present invention. At the outer periphery of the V-zone 37, the flakes 16 remain uninfluenced by the flux lines 18 of the magnet 10 and remain in the random position 40.

It will be apparent to those skilled in the art that this alignment phenomenon, along with the number of zones of influence of the magnetically active flakes 16, may vary depending upon the type and strength of magnet used, along with the orientation and geometry of the flux lines 18. For instance, it has been observed that when a bar magnet 10 such as that depicted in FIGS. 1 and 2 is placed on its side, i.e. rotated 90 degrees, and introduced to the medium, the void zone 33 is generally not observed and the flakes 16 tend to completely align throughout the area of the dispersion medium 14 influenced by the flux lines 18 of the magnetic field 17. Additionally, the polarities of the magnet 10 and the induced magnetic charges 50 of the flakes 16 may vary from that depicted herein, as can be appreciated by those skilled in the art.

The factors which govern the flake alignment phenomenon include: composition of the dispersion medium; strength of the magnetic field; diameter of the magnetic field; density and orientation of flux lines;

aspect ratio of the magnetically active flakes, preferably with at least two of the relative measurements of length, width and height of the flakes having a relative ratio of at least about 5:1, and most preferably, a ratio of at least about 10:1; density of the flakes relative to that of the dispersion medium; and mass of the flakes.

Dispersion Medium

The dispersion medium preferably comprises particular densities, viscosities, and thixotropies which, in conjunction with the particular magnetically active flakes used, keep the magnetically active flakes evenly suspended throughout the dispersion medium and assist in providing the alignment and change in light transmission characteristics of the present invention.

Any suitable dispersion medium for the magnetically active flakes can be employed in conjunction with the present invention. The dispersion medium should be capable of surrounding the magnetically active flakes so as to allow them to change orientation and align along the flux lines of an applied magnetic field.

The suspended magnetically active flakes in the dispersion medium of the present invention preferably have a density such that the flakes will remain suspended therein in a generally uniform layer without a great tendency to either sink or float. Therefore, the density of the dispersion medium should be approximately the same as that of the magnetically active flakes so that the flakes are supported substantially at equilibrium without rising or sinking.

The viscosities and/or thixotropies of the dispersion medium should be such that the interaction of the magnetically active flakes to each other and to the magnetic field are properly controlled. Therefore, the dispersion medium preferably comprises viscosities and/or thixotropies such that a certain minimum force must be applied by the magnetic field on the magnetically active flakes in order to align the magnetically active flakes, yet overcome the viscous and thixotropic properties of the dispersion medium, and provide a degree of stability to the system by minimizing unwanted disorientation of the magnetically active flakes. Densities, viscosities, and thixotropies are imparted by the dispersion medium itself, or mixtures of medium, as well as by the introduction of agents providing desired densities, viscosities, and/or thixotropies.

The magnetically active flakes are preferably substantially immobilized within the dispersion medium when at rest, yet exhibit the ability to align themselves in the dispersion medium along the flux lines of a magnetic field where the field is exposed to the flakes, yet not travel throughout the medium to the locus of the magnetic field. Thus, there is an interrelation between density, viscosity, and thixotropy in selecting the proper components of the dispersion medium.

Thixotropic agents have the property, when dispersed in suitable medium, of exhibiting a variable viscosity which depends on the shear stress applied to the flakes contained in the medium. At low shear stresses, or at rest, thixotropic dispersions have high viscosities in the nature of elastic solids, while at high shear stresses they have low viscosities. Thixotropic liquids are non-Newtonian, whereas non-thixotropic liquids are Newtonian liquids, i.e., thixotropic liquids behave like elastic solids at low shear, or at rest, and behave like liquids at high shear. Therefore, they are fundamentally different from viscous non-thixotropic liquids which behave like liquids both at rest and under low and high shear.

By controlling the thixotropy of the dispersion medium, the self-adjustments of the thixotropic system preferably impart proper variable viscosities under stress and static conditions. The magnetically active flakes of the present invention are thus limited from interacting and clumping when thixotropic liquids (i.e., which behave like solids at rest or low shear) are employed in the dispersion medium.

Typical thixotropic agents include inorganic substances such as montmorillonite clay (a tetraalkyl ammonium smectite), attapulgus clay (a crystalline hydrated magnesium aluminum silicate), silicon dioxide, organic thickeners such as processed derivatives of castor oil, polysaccharides, guar gum, starch, organic polymers such as carboxyvinyl polymers, cellulose derivatives and emulsions. Emulsions are defined as a heterogenous system consisting of at least one immiscible liquid dispersed in another liquid wherein at least one liquid will be water or an aqueous solution and the other liquid generally described as an oil phase. Metallic soaps, which are metal salts combined with high molecular weight, organic acid (fatty acids) such as stearic, lauric, oleic and behenic are also contemplated for use. The major metals used in this system include zinc, calcium, aluminum, magnesium and lithium. Organic soaps consisting of high molecular weight organic acids combined with organic alkyl salts are also contemplated.

A dispersion medium having thixotropic properties preferably encases the magnetically active flakes firmly and securely when at rest. Yet, where the flakes are placed under the influence of a magnetic field where movement of the flakes to align them along the lines of flux is desired, the thixotropic dispersion medium surrounding the magnetically active flakes liquifies when subjected to the stress from the movement of the flakes due to the influence of the magnetic field, thereby allowing movement of the flakes to align with the flux lines of the magnetic field.

The relationship between the mass and density of the magnetically active flakes with the viscosity and density of the dispersion medium is also important. It is desirable that the flakes be held within the dispersion medium in buoyant suspension and not travel throughout the medium when subjected to the magnetic field. Unless the dispersion medium is quite viscous, the magnetically active flakes, if lighter than the dispersion medium, will rise and break out to the surface of the medium, or, if denser, will fall to the bottom of the medium.

A wide variety of materials which have these characteristics can be employed in preparing the dispersion medium. These materials may preferably comprise both organic and inorganic thickeners, including both natural and synthetic polymers or mixtures of both natural and synthetic polymers.

Thus, an important aspect of the present invention relates to the choice of dispersion medium composition with specific densities, viscosities and thixotropies in conjunction with the choice of magnetically active flakes. The properties of the dispersion medium combine to limit displacement and travel of the magnetically active flakes throughout the dispersion medium both at rest and when influenced by a magnetic field. Preferably, the uniform distribution of the magnetically active flakes throughout the medium and the ability of the flakes to align along the flux lines to change the light transmission properties of the dispersion medium is maintained throughout repeated and rigorous use of the present invention.

The dispersion medium of the present invention also preferably comprises non-electrostatic properties which give the medium the ability to disperse electrons produced by electrostatic movement of the flakes through the dispersion medium, preventing the accumulation of electrostatic areas within the medium which may retard or prevent subsequent proper alignment or distribution of the magnetically active flakes.

It is quite evident that other dispersion medium, gels and emulsion systems; other suspending or carrier fluids permitting mobility, including thixotropic agents; other magnetically active flakes or magnetically induced particles or flakes; other types of magnets or magnetic fields; etc., are known or will be developed continually which could be used in this invention. It is, therefore, impossible to attempt a comprehensive catalogue of such components. To attempt to describe the invention in its broader aspects in terms of specific components which could be used would be too voluminous and unnecessary since one skilled in the art could, by following the description of the invention herein, select useful dispersion medium, thixotropic and viscous agents, magnetic fields and magnetically active flakes for the present invention. From the description in this specification, and with the knowledge of one skilled in the art, one will know or deduce with confidence the applicability of specific components suitable in this invention.

Thus, the examples given herein are intended to be illustrative, and various modifications and changes in the materials, structures and compositions may be apparent to those skilled in the art without departing from the spirit of this invention.

Examples of Thixotrooic and Viscous Agents

| |
|---|
| A. Carboxyl Vinyl Polymers |
| B. Cellulose Derivatives |
| 1. Sodium Carboxymethycellulose |
| 2. Hydroxyrthylcellulose |
| 3. Hydroxypropylcellulose |
| C. Polysaccharides |
| 1. Xanthan Gum |
| D. Natural Thickeners |
| 1. Algin |
| 2. Guar Gum |
| 3. Starch |
| 4. Tragacanth |
| 5. Locust Bean Gum |
| E. Polyvinylpyrrolidone (PUP) |
| 1. PVP/Vinyl Acetate Co-Polymers |

Examples of Dispersion Medium

The following are examples of the dispersion medium of the present invention. The following examples in which all proportions are given in parts by weight, unless otherwise indicated, will serve to illustrate, but not limit, the present invention.

A. Oil-Based Medium

| Components | |
|---|---|
| 1. Mineral Oil | 40 parts |
| ethylene glycol monostearate | 5 parts |
| calimulse PRS (Pilot Chemical, Santa Fe Springs, CA) | 5 parts |
| 2. propylene glycol | 5 parts |
| petrolatum | 6 parts |
| water | 39 parts |

Procedure: Melt and mix the components of group 1 at 160° F., add the components of group 2 to the mixture of group 1 with mixing at 160° F., slowly cool (add additional water if necessary to proper viscosity). Finally, add 2 parts by weight of nickel flakes.

B. Micellar Gels

Micelles are aggregated units of molecules of a surface active material (surfactants), formed as a result of the thermodynamics of the interaction between the solvent (usually water) and lyophobic (or hydrophobic) portions of the molecule.

A micellar gel is a term used to describe the irreversible union of two or more surfactant-forming ingredients, one of which consists of a water-immiscible hydrophobic, saturated, or unsaturated fatty acid (oleic, stearic, palmitic, etc.) or alkyl benzene such as docylbenzene sulfuric acid, in addition to an alkali hydrophilic salt such as triethanolamine, monoethanolamine, isopropanolamine or sodium hydroxide. The gel described herein is formed by the controlled addition and agitation of the proper amount of the alkali constituent to the acid constituent to form a gel. These gels can be modified by the addition of a non-ionic surfactant prior to the addition of the hydrophobic ingredients. The addition of non-ionic surfactant allows water to be added in small amounts in order to control the viscosity of the gel.

Components

| Components: | |
|---|---|
| Oleic acid | 7 parts |
| Non-ionic alkyl phenylpolyether ethanol | 10 parts |
| Triethonolamine | 2 parts |
| Water | 50 parts |

Procedure: The Oleic acid is added with mixing to the nonionic alkyl phenylpolyether ethanol. The triethanolamine is then slowly mixed to form a gel. Add water to adjust to proper viscosity. Finally, add 2% by weight to the total gel formula of nickel flakes.

C. Emulsions

| Components: | |
|---|---|
| Triton X-100 (Rohm & Haas) | 10.0 parts |
| Mineral Oil | 51.0 parts |
| Oleic Acid | 4.0 parts |
| Stearic Acid | 3.0 parts |
| Sodium Hydroxide | .5 parts |
| Water | 31.5 parts |

Procedure: Triton X-100, stearic acid and oleic acid are added to the mineral oil and agitated until homogenous. To ease the solution of the stearic acid, heat the mineral oil to 160° F. Make a concentrate from the sodium hydroxide in part of the water and add to the above mixture. Continue subsurface agitation until uniform. Slowly add the remainder of the water and stir until smooth. The final product is a white opaque paste. The viscosity can be lowered or raised by the addition of increments of water or mineral oil. To the above, add 3 parts by weight of stainless steel flakes.

D. Inorganic Thickeners

| Components: | |
|---|---|
| betone | 5 parts |
| vegatable oil | 90 parts |
| non-ionic surfactant | 5 parts |

Procedure: Add the bentone to the vegetable oil with high shear agitation. A medium with a gel-like consistency will form slowly; next add the non-ionic surfactant. Blend in 2.5 parts by weight of nickel flakes at moderate speed.

E. Organic Thickeners

| Components: | |
|---|---|
| xanthan gum | 3 parts |
| glycerin | 5 parts |
| non-ionic surfactant | 2 parts |
| water | 90 parts |

Procedure: Dissolve and thoroughly mix xanthan gum and water. Add the glycerin and the non-ionic surfactant to the xanthan/water gel slowly. Allow the above to settle for at least 24 hours to expel the air bubbles. Finally, add 3 parts by weight of nickel flakes with moderate agitation.

F. Water-Soluble Resins

| Components: | |
|---|---|
| carboxymethylcellulose | 2 parts |
| propylene glycol | 10 parts |
| water | 88 parts |
| non-ionic surfactant | 5 parts |

Procedure: Add the propylene glycol to the water. With very low speed agitation, add the carboxymethyl cellulose to form a slurry. Gradually increase agitation until a clear gel has been formed. Add the non-ionic surfactant to the gel. Finally, with moderate agitation, add three parts by weight of stainless steel flakes.

Examples of Magnetically Active Flakes

Examples of suitable magnetically active flakes which can be used in this invention include flakes comprising magnetic metal materials made of alloys based on, for example, iron, cobalt, or nickel and granulated forms of these materials. If necessary, the flakes may be adjusted for their color tone. However, any appropriate magnetically active flakes as known to those skilled in the art are contemplated for use in the present invention. The following are examples of flakes having characteristics desirable for use in the present invention.

| | Spec. Grav. g/cm$^3$[a] | Apparent Density g/cm$^3$[b] | Thickness in (microns) | Screen Analysis[3] % +250 | +325 | −325 |
|---|---|---|---|---|---|---|
| Nickel | 6.69 | 1.39 | 0.37 | 2.3 | 3.4 | 94.3 |

-continued

| | Spec. Grav. g/cm$^3$[a] | Apparent Density g/cm$^3$[b] | Thickness in (microns) | Screen Analysis[3] % +250 | +325 | −325 |
|---|---|---|---|---|---|---|
| Leafing [a] | | | | | | |
| Nickel Leafing [b] | 7.60 | 1.19 | 0.47 | 2.5 | 3.8 | 93.7 |
| Stainless Steel [a] | 6.53 | 1.03 | 0.88 | 0.8 | 21.4 | 7.8 |
| Stainless Steel [b] | 6.68 | 1.52 | 0.83 | 1.6 | 12.7 | 85.7 |
| Stainless Steel [c] | 6.99 | 1.22 | 1.00 | 69.2 | 18.2 | 12.6 |
| Stainless Steel [d] | 7.14 | 1.07 | 1.00 | 45.0 | 43.6 | 11.4 |

[a]As determined by ASTM Standard 329.
[b]As determined by Scott Volunteer (ASTM Standard B 329).
[c]U.S. Standard Service.
(Nickel - 99.9% Ni)
(Stainless Steel - 68% Fe, 17% Cr, 13% Ni, 2% MO)

However, it will be appreciated by those skilled in the art that a variety of the non-metallic flakes having magnetically active properties may be used with the present invention. For instance, polymeric substances having magnetically active coatings are contemplated for use in the present invention.

The amount of flakes added to the dispersion medium may vary according to a number of factors, the factors including: the composition of the flakes; the size of the flakes; the amount of display contrast desired; the strength of the magnet; and the composition of the dispersion medium. However, it is contemplated that the percent weight of the magnetically active flakes in relation to the weight of the dispersion medium may preferably comprise between about 0.25% by weight to about 10% by weight of the dispersion medium, and, most preferably, between about 1% by weight to about 5% by weight. However, those skilled in the art will appreciate that these ranges may be varied beyond those presently indicated, depending upon the particular application of the present invention and the composition of the dispersion medium.

Colorants

In addition to the special benefit of the flake configuration as to its magnetic attraction, the magnetically active flakes of the present invention may preferably comprise a high specular reflectance. Thus, the flakes used in the present invention preferably comprise flat surfaces which reflect light and produce a smooth-looking coating when distributed randomly within the dispersion medium and viewed from a transparent or translucent surface. The magnetically active flakes can be further coated with a metallic substance such as silver or gold, or with a ceramic or other appropriate coating or colorant to enhance the contrast or provide a particular color in conjunction with specific use of the present invention.

If desired, the addition of colorants to the dispersion medium are also contemplated for use with the present invention. Dark-colored pigments or dyes that are soluble in the dispersion medium are preferred for use with the present invention, providing in appropriate instances increased contrast between those areas of the dispersion medium containing aligned flakes, and adjacent areas where the flakes are randomly distributed.

Display Apparatus

The apparatus of the present invention preferably comprises an enclosure into which the dispersion medium is placed, the enclosure comprising at least one transparent or translucent surface area. In a preferred embodiment depicted in FIGS. 3 and 4, the enclosure 50 of the present invention comprises two spaced planar surfaces 53, 55 having interposed therebetween the dispersion medium 14 in a liquid sealing space 51, the medium 14 bearing in suspension the magnetically active flakes 16.

In a preferred embodiment, the space 51 between the two surfaces 53, 55 comprising the enclosure 50 may be varied according to the specific application of the display apparatus. To provide a sharp display with high contrast and good erasure capability, the surfaces may be spaced by a distance of from about 5 to about 500 mm, preferably from about 5 to about 25 mm. The front surface 53 from which the display is read preferably comprises a transparent material, but, dependent on the particular application, it may comprise a translucent material. In either case, a variety of different plastics and glass can be employed.

The other, or rear, surface 55 need not necessarily be made of a transparent material and, hence, a wide variety of plastics, glass, and metals can be used. However, in a preferred embodiment, both the front 53 and rear 55 surface comprise an area comprising a transparent or translucent material capable of providing an observation of the change of the light transmission characteristics of the dispersion medium 14.

In instances where both the front 53 and rear 55 surfaces comprise a transparent or translucent material, the apparatus may be configured such that the display of a magnetic field to one side of the apparatus will align the flakes 16 throughout the dispersion medium 14 between the surfaces 53, 55 such that light is allowed to be transmitted through both of the surfaces 53, 55 and the dispersion medium 14 in areas of flake alignment.

In another preferred embodiment, the apparatus may be configured such that images may be produced separately on the opposing sides of the enclosure 50, such that they are separately viewable through the opposing surfaces 53, 55 of the enclosure 50. In instances where two or more different images are to be separately produced to be viewed on opposing surfaces 53, 55 of the enclosure 50, special consideration should be given to a variety of factors including: the thickness of the dispersion medium between the surfaces; the thickness of the surfaces; and the strength of the magnetic field. Those skilled in the art will appreciate that these factors, among others, determine whether the alignment of the flakes 16 produces an image in the dispersion medium 14 throughout the space 51 between the surfaces 53, 55 when the flux lines 18 of the magnetic field 17 are exposed to only one surface, 53 or 55; or whether the alignment of the flakes 16 produces an image in the dispersion medium 14 only observable through the surface 53, 55 to which the magnetic field 17 is exposed. Alignment of the flakes 16 in the second instance preferably allows the enclosure 50 to have separate images produced along and visible through opposing surfaces 53, 55, the images preferably not interfering with each other.

If manual redistribution and orientation of the magnetically active flakes is desired to produce image erasure, one or both or the surfaces 53, 55 preferably comprises a flexible material which can be deformed by the user to physically re-orient the magnetically active flakes 16 to a random orientation within the dispersion medium 14, thus restoring the original light transmission characteristics of the medium 14.

The thickness of the surfaces 53, 55 is important. The thickness of the surfaces 53, 55 is preferably from about 0.5 to about 1.0 mm; if the thickness goes beyond 1.0 mm, the image may have less contrast due to the reduction of the relative strength of the magnetic field 17 as the magnet 10 is displaced further away from the flakes 16 within the dispersion medium 14. The front 53 and rear 55 surfaces may be formed of one continuous piece by procedures known in the art such as by conventional molding techniques, or the surfaces may also be bonded together by, for instance, heat-sealants or adhesives.

A preferred embodiment of the enclosure 50 of the present invention comprises the surfaces 53, 55 comprising Polyvinylchloride (PVC) or Copolymer containing Vinyl Chloride, Polyethylene Terephthalate (PET), polycarbonates, acetates, or other appropriate polymeric material.

The front surface 53 may be affixed to the rear surface 55 by means of an adhesive over the peripheral edges of the surfaces. The edges 59 of the surfaces 53, 55 can also be secured together by the use of high-frequency welding, ultrasonics, or similar processes familiar to those of ordinary skill in the art. One of the surfaces may preferably be recessed in part to provide a chamber between the surfaces in which is located the dispersion medium 14. However, it will be apparent to those skilled in the art that the enclosure 50 of the present invention may also comprise surfaces which are non-planar, the enclosure 50 comprising surfaces which produce a three-dimensional configuration of the enclosure, these configurations including spheres, cubes and cylinders.

In operation, the flux lines 18 of the magnetic field 17 are displayed to and pass through a surface 53, 55 of the enclosure 50, causing the magnetically active flakes mixed within the dispersion medium to orient themselves and align along the flux lines of the magnetic field, creating an image. It is this alignment of the magnetically active flakes which causes an image to take place as a result of a change in the transmission of light through and into the dispersion medium 14. Thus, when the flux lines 18 of the magnetic field 17 are introduced to the flakes 16 as depicted in FIG. 1, the flakes 16 align with the longitudinal axis of each of the flakes 16 becoming oriented such that they are preferably generally aligned along and generally parallel to the flux lines 18 of the magnetic field 17 which influences the area of the dispersion medium 14 in which the flakes 16 are dispersed. While lined up along the flux lines 18, the magnetically active flakes 16 change the light transmission characteristics of the dispersion medium 14, thus producing an image.

In a preferred embodiment, the image produced by the magnetic display of the present invention is effected by a magnet 10. The magnetic field 17 of the magnet 10 acts upon the suspended magnetically active flakes 16 in an area adjacent to the locus of the magnet tip. Moving the magnet tip over the enclosure 50 causes the flakes 16 in an area adjacent to the surface of the enclosure 50 to be oriented from a random position to another position essentially vertical to the tip of the magnet 10, the flakes 16 aligned along the flux lines of the magnetic field 17 as previously described. To the observer, this re-orientation of flakes 16 produces a black image, in contrast to the metallic sheen of the remainder of the essentially non-aligned, randomly distributed magnetically active flakes 16 unaffected by the magnetic field 17.

Methods of Erasure

An important aspect of the present invention is the ability of the user to selectively or completely erase the image produced by non-magnetic means.

After an image is formed, it may be desirable to erase the image such that the original light transmission characteristics of the dispersion medium 14 in the areas of flake alignment are recalled. Erasure, as defined in the present invention, preferably comprises returning the flakes 16 from their aligned position to their random state existing prior to the production of the image within the dispersion medium 14, the erasure of the image discretely or completely. Non-magnetic erasure means are preferably employed to effect the erasure of an image.

Examples of applicable erasure means include: (1) applying pressure to the surface of the enclosure, such that the surface is deformed and contacts the dispersion medium, redistributing the dispersion medium 14 in the area of deformation to randomly orient the flakes 16, thus providing complete or selective erasure of the image previously produced; (2) sliding or moving one of the surfaces of an apparatus having opposing surfaces laterally in relation to the opposite surface, or, alternatively, sliding or moving an erasure means, preferably comprising a separate surface, panel or roller located between or outside the surfaces of a planar apparatus or a three dimensional enclosure, such that the surface or erasure means contacts the dispersion medium 14 and causes the medium 14 to redistribute and thus randomly orient the flakes 16; and (3) shaking the entire magnetic display device, manually or mechanically, to cause the dispersion medium 14, and thus the flakes 16, to redistribute to a random orientation.

The manual or mechanical erasure as described in (3) is particularly efficacious when the apparatus of the present invention comprises an enclosure having a three-dimensional display area, such as that of a bottle. This means of erasure can be used to erase images produced in a dispersion medium 14 which fills an enclosure or, alternatively, in a medium 14 distributed as a coating on the interior of an enclosure which contacts and covers the inside of the enclosure, yet does not fill the enclosure.

Figure 3:
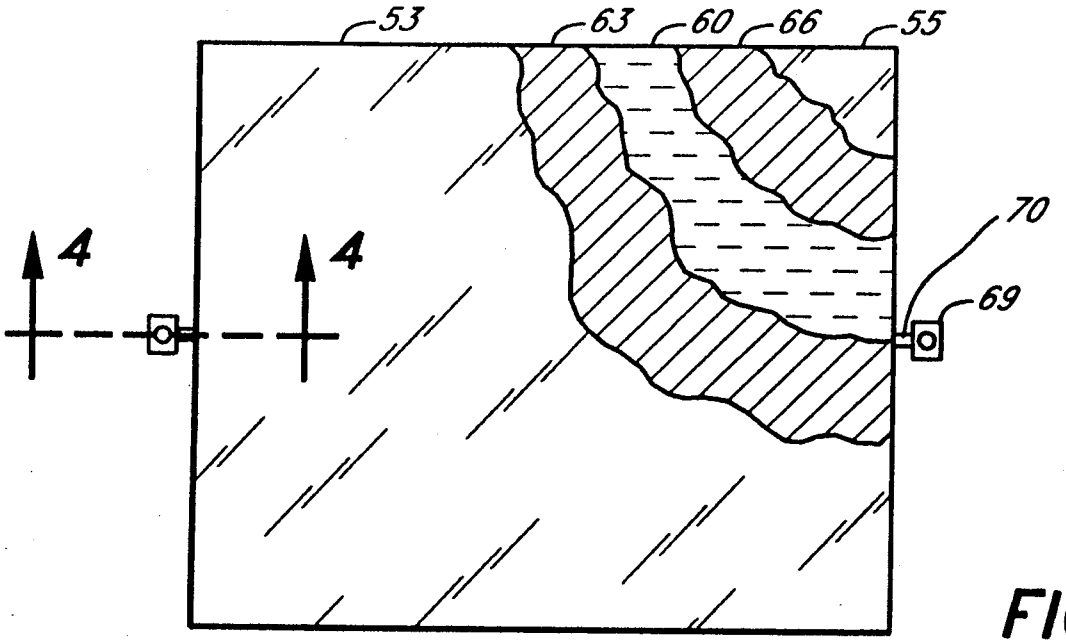
FIG. 3 is a plan view of a preferred embodiment of the apparatus of the present invention.
Figure 4:
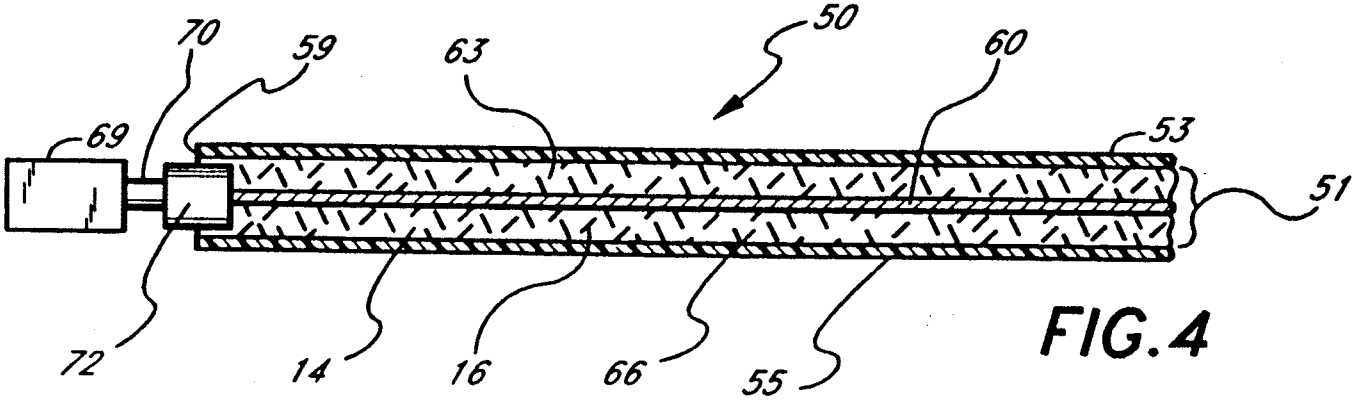
FIG. 4 is a fragmentary cross-sectional view of a preferred embodiment of the apparatus of FIG. 3, taken along line 4—4.

Referring to FIGS. 3 and 4, an erasure means comprising a erasure panel 60 is shown in conjunction with a preferred embodiment of the present invention. The erasure panel 60 is disposed between the surfaces 53, 55, within the liquid sealing space 51 and defines a first image area 63 and a second image area 66 located between the panel 60 and the surfaces 53, 55. The dispersion medium 14 is located within the image areas 63, 66, and is preferably in fluid communication with the panel 60 and the surfaces 53, 55. The erasure panel 60 is connected to a handle 69 located outside the enclosure 50, the handle 69 connected to the panel 60 by a connecting rod 70. To ensure a fluid-tight seal throughout the enclosure 50, the connecting rod 70 is inserted through a gasket 72 which extends through the edge 59 of the surfaces 53, 55.

In use, the handle 69 is translated so that the connecting rod 70, surrounded by gasket 72, moves the erasure panel 60 laterally. The panel 60 contacts the dispersion medium 14 located in the image areas 63, 66, moving the medium 14 between the surfaces 53, 55 and the panel 60, thus causing the medium 14 to redistribute in the areas 63, 66.

With each of the above-described erasure methods, the object is to physically orient the flakes 16 away from their aligned position and randomly orient the flakes 16 so that the light transmission characteristics of the dispersion medium 14 return to the random state existing prior to production of the image. However, other methods of erasure or distribution of the flakes 16 apparent to those skilled in the art are contemplated for use in the present invention.

While particular embodiments of the invention have been described in detail, it will be apparent to those skilled in the art that the disclosed embodiments may be modified. Therefore, the foregoing description is to be considered exemplary, rather than limiting, and the true scope of the invention is that defined in the following claims.

I claim:

1. A magnetic marking apparatus, comprising:

an enclosure having a plurality of transparent or translucent surfaces;

a dispersion medium having a plurality of randomly oriented, magnetically active flakes contained within said enclosure; and a magnet outside said enclosure having a magnetic field, said magnetic field having a plurality of flux lines, said flakes aligning along said flux lines when said magnetic field is displayed to said flakes, said dispersion medium containing aligned flakes having light transmission characteristics different from said dispersion medium containing said randomly oriented magnetically active flakes.

2. The apparatus of claim 1, wherein said magnetically active flakes include nickel.

3. The apparatus of claim 1, wherein said flakes have an aspect ratio having at least two of the height, length or width measurements of about 5:1 or greater.

4. The apparatus of claim 1, wherein said flakes have an aspect ratio having at least two of the height, length or width measurements of about 10:1 or greater.

5. The apparatus of claim 1, wherein said transparent surface area is deformable to the touch.

6. The apparatus of claim 1, wherein said transparent or translucent surface is planar.

7. The apparatus of claim 1, wherein said enclosure has two spaced, parallel planar surfaces.

8. The apparatus of claim 1, wherein said dispersion medium includes a thixotropic agent.

9. A magnetic display panel, comprising:

an enclosure having a front and a rear surface, with said front surface and said rear surface having a transparent or translucent area, said rear surface spaced from said front surface to form a liquid sealing space;

a dispersion medium sealed within said liquid sealing space, said dispersion medium having disposed therein a plurality of randomly oriented, magnetically active flakes; and a magnet outside said enclosure having a magnetic field, said magnetic field having a plurality of flux lines, said flakes aligning along said flux lines when said magnetic field is displayed to said flakes, said aligned flakes changing the light transmission characteristics of said dispersion medium.

10. The panel of claim 9, wherein said flakes have an aspect ratio having at least two of the height, length or width measurements of about 5:1 or greater.

11. The panel of claim 9, wherein said flakes have an aspect ratio having at least two of the height, length or width measurements of about 10:1 or greater.

12. A method for creating an image, comprising:
providing a dispersion medium having a thixotropic agent;
providing a plurality of magnetically active flakes;
mixing said magnetically active flakes within said dispersion medium;
providing an enclosure having at least one transparent or translucent areas;
distributing said dispersion medium within said enclosure;
randomly orienting said magnetically active flakes;
providing from outside said enclosure a magnetic field having a plurality of flux lines;
displaying said magnetic field to said enclosure; and
creating an image visible through said area within said dispersion medium by aligning a portion of said flakes along said flux lines.

13. The method of claim 12, further comprising the step of erasing said image by redistributing said dispersion medium within said enclosure, said erasing step randomly orienting said magnetically active flakes throughout said dispersion medium.

14. The method of claim 13, wherein said erasing step is performed by applying pressure against said enclosure, said enclosure deforming during application of said pressure to contact and redistribute said dispersion medium.

15. The method of claim 13, wherein said erasing step is performed by shaking the enclosure such that the dispersion medium is redistributed within said enclosure.

16. The method of claim 13, wherein said erasing step further comprises the steps of providing an erasure means within said enclosure and moving said erasure means to contact and redistribute said dispersion medium within said enclosure.

17. The method of claim 13, wherein said erasing step comprises discrete erasing of said image.

18. The apparatus of claim 1, wherein said enclosure comprises two spaced parallel transparent or translucent surfaces, each of said surfaces allowing viewing of an image therethrough.

19. The panel of claim 9, wherein said front surface and said rear surface comprise a transparent or translucent area, said front surface and said rear surface each allowing viewing of an image therethrough.

20. A magnetic marking apparatus, comprising:
an enclosure having a plurality of transparent or translucent surfaces;
a dispersion medium having a plurality of magnetically active particles contained within said enclosure; and
a magnet outside said enclosure having a magnetic field such that application of said magnet to a first of said transparent or translucent surfaces causes movement of said magnetically active particles proximate said first surface which creates an image viewable through said first surface but not through a second of said transparent or translucent surfaces and such that application of said magnet to said second surface causes movement of said magnetically active particles proximate said second surface which creates an image viewable through said second surface but not through said first surface.

21. The apparatus of claim 20, wherein said plurality of transparent or translucent surfaces is two spaced, parallel, planar surfaces.

22. A magnetic marking apparatus, comprising:
an enclosure defining a single liquid sealing space and having a plurality of transparent or translucent surfaces through which said liquid sealing space is viewable;
a dispersion medium contained within said liquid sealing space having a plurality of magnetically active particles; and
a magnetic field selectively applicable to a portion of said dispersion medium sufficient to cause movement of said magnetically active particles in said portion of said dispersion medium.

23. A magnetic marking apparatus, comprising:
an enclosure having a plurality of transparent or translucent surfaces;
a dispersion medium contained within said enclosure having a plurality of magnetically active flakes; and
a magnetic field selectively applicable to a portion of said dispersion medium sufficient to cause alignment of said flakes in said portion of said dispersion medium so as to form an image viewable through a said surface, said image being erasable by manually shaking said apparatus.

24. A magnetic marking apparatus, comprising:
an enclosure having first and second spaced, parallel, planar transparent or translucent surfaces and a liquid sealing space therebetween;
a dispersion medium sealed in said liquid sealing space having a thixotropic agent and a plurality of magnetically active flakes with an aspect ratio having at least two of the height, length or width measurements of about 5:1 or greater; and
a magnet located outside said enclosure with a magnetic field having a plurality of flux lines and being strong enough so that application of said magnet to a point on said first surface causes said magnetically active flakes proximate said point to align along said flux lines, thereby changing the light transmission characteristics of said medium proximate said point from those distal said point and creating an image proximate said point when said dispersion medium is viewed through said first surface, but not when viewed through said second surface.

25. A method of forming an image, comprising the steps of:
providing a dispersion medium having a thixotropic agent;
providing a plurality of magnetically active flakes with an aspect ratio having at least one of the height, length or width measurements of about 50:7 or greater;
suspending said flakes in said dispersion medium;
providing an enclosure having a plurality of transparent or translucent surfaces and a liquid sealing space adjacent thereto;
sealing said dispersion medium in said liquid sealing space;
applying to said dispersion medium from outside said enclosure a magnetic field having flux lines; and aligning said flakes proximate said magnetic field along said flux lines, whereby said alignment changes the light transmission characteristics of said dispersion medium containing the aligned flakes so that the contrast between the dispersion medium containing the aligned flakes and the remainder of the dispersion medium produces an image visible through said transparent or translucent surface.

* * * * *